US007587059B2

(12) United States Patent
Wright

(10) Patent No.: US 7,587,059 B2
(45) Date of Patent: Sep. 8, 2009

(54) SNAP-IN AND LOCK BAFFLE

(76) Inventor: Doug S. Wright, 3554 Quincy Ave., Simi Valley, CA (US) 93063

( * ) Notice: Subject to any disclaimer, the term of this patent is extended or adjusted under 35 U.S.C. 154(b) by 852 days.

(21) Appl. No.: 10/871,069

(22) Filed: Jun. 18, 2004

(65) Prior Publication Data

US 2005/0045171 A1 Mar. 3, 2005

Related U.S. Application Data

(60) Provisional application No. 60/497,752, filed on Aug. 26, 2003.

(51) Int. Cl.
*H04R 1/02* (2006.01)
*H04R 9/06* (2006.01)
*H05K 5/00* (2006.01)

(52) U.S. Cl. ..... 381/387; 381/87; 381/433; 181/150

(58) Field of Classification Search ..... 381/87, 381/387, 386, 395, 433; 181/150, 148, 154, 181/171

See application file for complete search history.

(56) References Cited

U.S. PATENT DOCUMENTS 2,860,904 A * 11/1958 Barry et al. ..... 292/256
3,849,839 A * 11/1974 Zimber ..... 24/109
4,917,212 A * 4/1990 Iwaya ..... 181/141
5,143,339 A 9/1992 Ashcraft et al.
D340,718 S 10/1993 Leger et al.
5,331,119 A * 7/1994 Leger et al. ..... 181/150
5,734,732 A * 3/1998 Lemmon ..... 381/386
5,867,583 A 2/1999 Hazelwood et al.
5,952,619 A 9/1999 Kantor et al.
D419,561 S 1/2000 Haase et al.
6,026,927 A * 2/2000 Burdett et al. ..... 181/144
6,070,694 A 6/2000 Burdett et al.
6,101,262 A 8/2000 Haase et al.
6,375,142 B1 4/2002 Miller et al.
D461,464 S 8/2002 Sterns et al.
6,487,299 B1 * 11/2002 Peng ..... 381/395
D475,364 S 6/2003 Sterns et al.
6,588,543 B1 * 7/2003 Tchilinguirian ..... 181/150
6,683,963 B2 1/2004 Sterns et al.
7,171,013 B2 * 1/2007 Kosatos et al. ..... 381/182
2004/0047487 A1 * 3/2004 Popken et al. ..... 381/395

* cited by examiner

*Primary Examiner*—Curtis Kuntz
*Assistant Examiner*—Jesse A Elbin
(74) *Attorney, Agent, or Firm*—Julio M. Loza; Loza & Loza, LLP

(57) ABSTRACT

A baffle assembly fastening system and mounting frame assembly that can be installed and secured without the use of tools. A baffle assembly frame defining an opening to receive a fixture and having an exposed first surface. A fastener is rotationally coupled to the baffle frame. The fastener extends from the exposed first surface to secure the baffle assembly to a recessed mounting frame, wherein the fastener can be manually rotated from a disengaged position to an engaged position in less ring is coupled to the baffle assembly and has a plurality of aligning posts that serve to align the baffle assembly as it is inserted into a recessed mounting frame.

18 Claims, 10 Drawing Sheets

SNAP-IN AND LOCK BAFFLE

CROSS REFERENCE TO RELATED APPLICATIONS

This non-provisional United States (U.S.) patent application claims the benefit of provisional U.S. Patent Application No. 60/497,752, filed Aug. 26, 2003; and is related to U.S. patent application Ser. No. 10/871,112 filed on Jun. 18, 2004 by inventor Doug S. Wright, titled "Tool-Less Frame Fastening System", and is also related to U.S. patent application Ser. No. 10/871,111 filed on Jun. 18, 2004 by inventor Doug S. Wright, titled "Angled Speaker Assembly."

FIELD

Various embodiments of the invention pertain to a baffle assembly. More particularly, at least one embodiment of the invention relates to a device, system, and method for fastening an integrated speaker and baffle assembly into a recessed mounting assembly.

DESCRIPTION OF RELATED ART

Various types of apparatus, such as speakers, vents, and exhaust fans, are often mounted within a wall or ceiling cavity or recess. A frame assembly is commonly mounted within a wall or ceiling cavity to retain these devices. Various types of baffle frames and fasteners are used for the purpose of securing a baffle, cover, shield, or grate over the device to hide it from view.

Many conventional devices, such as speakers, may be mounted to a frame assembly within a wall or ceiling recess. A baffle is then fitted, either by pressure or by a fastener, to cover the speaker. This process is often cumbersome, time consuming and laborious in many cases since it requires that the installer use tools to secure the speaker to the frame assembly and then install a separate baffle to cover the fasteners and speakers. For example, when installing a recessed speaker within a ceiling cavity the installer would have to hold the speaker frame in place with one hand while trying to turn a screw to secure the speaker to a previously installed mounting frame. Then a cover or baffle is used to cover the speaker. Moreover, conventional baffles and speakers are not easy to remove and/or replace when maintenance may be required.

Consequently, conventional baffle and speaker securing systems are typically cumbersome and time-consuming to install, take many steps to mount, and require the use of several tools. This increases the cost of installation and deployment of, for instance, recessed speakers, lights, or exhaust fans.

SUMMARY

One embodiment of the invention provides a manually mounted a speaker baffle assembly. The baffle assembly includes a baffle frame defining an opening to receive a fixture (e.g., speaker). The baffle frame has an exposed first surface visible to users. A fastener is rotationally coupled to the baffle frame and extends from the exposed first surface to secure the baffle assembly to a recessed mounting frame. The fastener can be manually rotated from a disengaged position to an engaged position in less than one full turn.

The baffle assembly also includes a retaining ring coupled to the baffle frame, the retaining ring having a plurality of aligning posts that serve to align the baffle assembly as it is inserted into a recessed mounting frame. The retaining ring includes an angled sidewall along the circumference of the opening defined by the baffle frame.

The baffle assembly may also include an inner mounting assembly to couple to a fixture (e.g. speaker), the inner mounting assembly having an angled sidewall to slide against the angled sidewall of the retaining ring and provide a desired angle for the fixture.

According to one embodiment of the invention, the fastener includes a tensioning pin, a knob coupled to a first end of the tensioning pin on the exposed first surface, a tensioning spring along the tensioning pin, and a securing foot coupled to a second end of the tensioning pin. Rotating the knob causes the tensioning pin and securing foot to rotate and engage one or more spring fingers in the recessed mounting frame to secure the baffle assembly to the recessed mounting frame.

The baffle frame includes at least one passage through which a fastener extends from the exposed first surface to an opposite end, the passage including a tensioning ramp edge along the circumference of the passage, a knob on the fastener rotates on the tensioning ramp edge to secure the baffle assembly. The fastener may be manually rotated from a disengaged position to an engaged position in approximately one half turn. The fastener includes a visible finger actuator, the finger actuator to align with a rib on the exposed first surface when the fastener is in the engaged position. The baffle assembly remains free to rotate three hundred and sixty degrees even when the fastener secures the baffle assembly to the recessed mounting frame.

DETAILED DESCRIPTION

In the following description numerous specific details are set forth in order to provide a thorough understanding of the invention. However, one skilled in the art would recognize that the invention may be practiced without these specific details. In other instances, well known methods, procedures, and/or components have not been described in detail so as not to unnecessarily obscure aspects of the invention.

In the following description, certain terminology is used to describe certain features of one or more embodiments of the invention. For instance, "fastener" and "retainer" are interchangeably used to refer to any type of securing mechanism. The term "speaker" is used to refer to any type of sound-generating device such as audio electronic equipment, loudspeakers, audio speakers, woofers, subwoofers, audio mixers, tweeters, and acoustic transducers.

One aspect of the invention provides a baffle assembly fastening system and mounting frame assembly that can be installed and secured without the use of tools.

Figure 1:
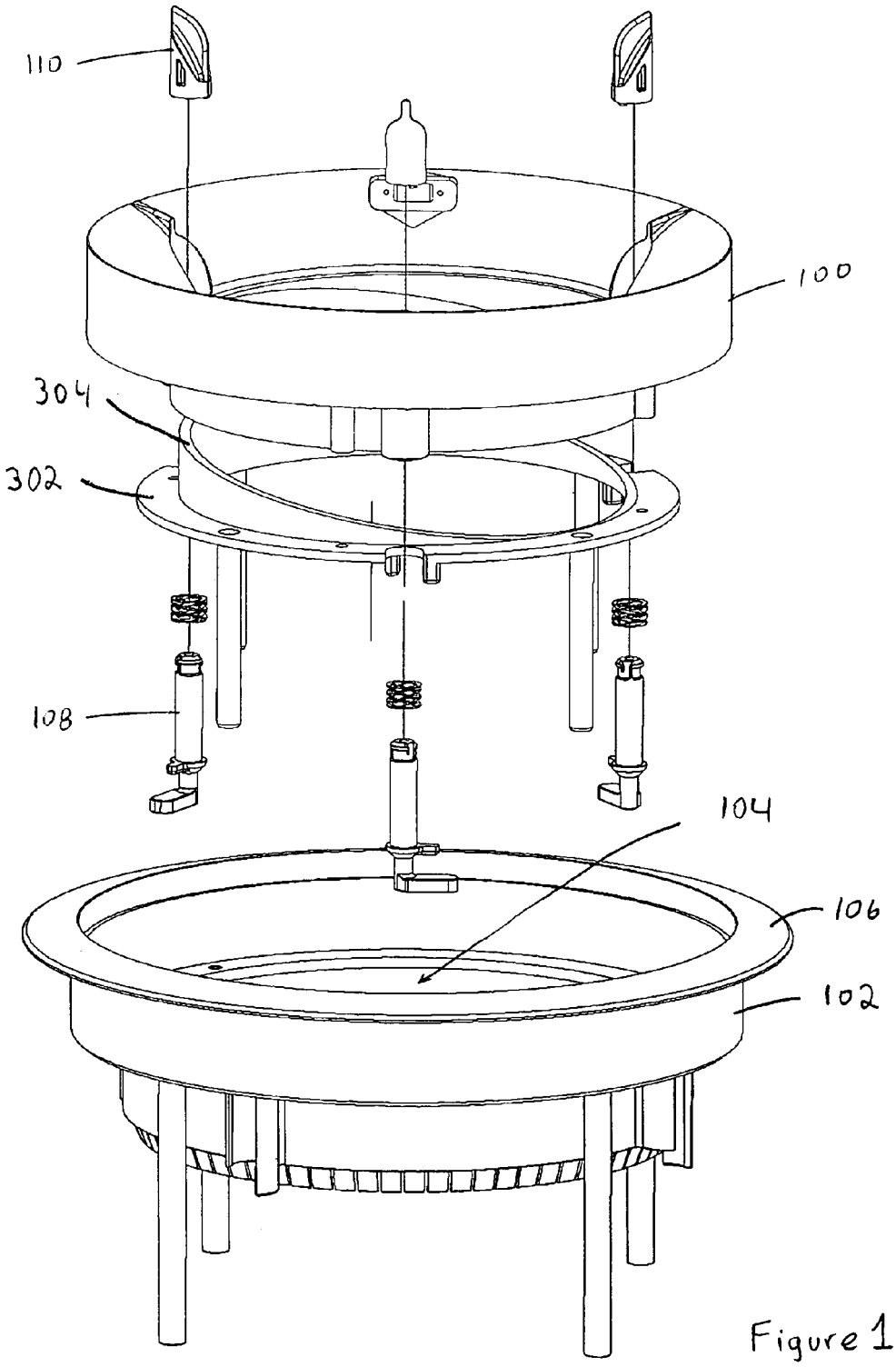
FIG. 1 illustrates an exploded side-view of a baffle assembly fastening system and mounting frame assembly according to one embodiment of the invention.

FIG. 1 illustrates an exploded side-view of a baffle assembly fastening system 100 and mounting frame assembly 102 according to one embodiment of the invention. The baffle assembly 100 and mounting frame assembly 102 do not require the use of hand-tools or power-tools for its installation, aside from a saw to cut the receiving hole or recess in the wall or ceiling. This mounting frame assembly 102 and baffle assembly 100 system incorporates an alignment free, snap-in retention system that allows free, three-hundred and sixty degrees (360°), rotation after insertion, is lockable to eliminate buzz and rattle and does not require tools to fully affix.

The mounting frame assembly 102 may be secured within a recess in a wall or ceiling and then the baffle assembly 100 may be secured to the mounting frame assembly 102. For this purpose, baffle assembly may include a tool-less fastening system having a rotating tensioning pin 108 and a locking knob 110.

According to one implementation of the invention, the mounting frame assembly 102 is substantially circular and defines a cavity or opening 104 through which a speaker or other components may be mounted. The mounting frame assembly 102 may include a border flange 106 which may serve as an external trim once the mounting frame assembly 102 is mounted within a ceiling or wall recess in a number of different ways.

Figure 2:
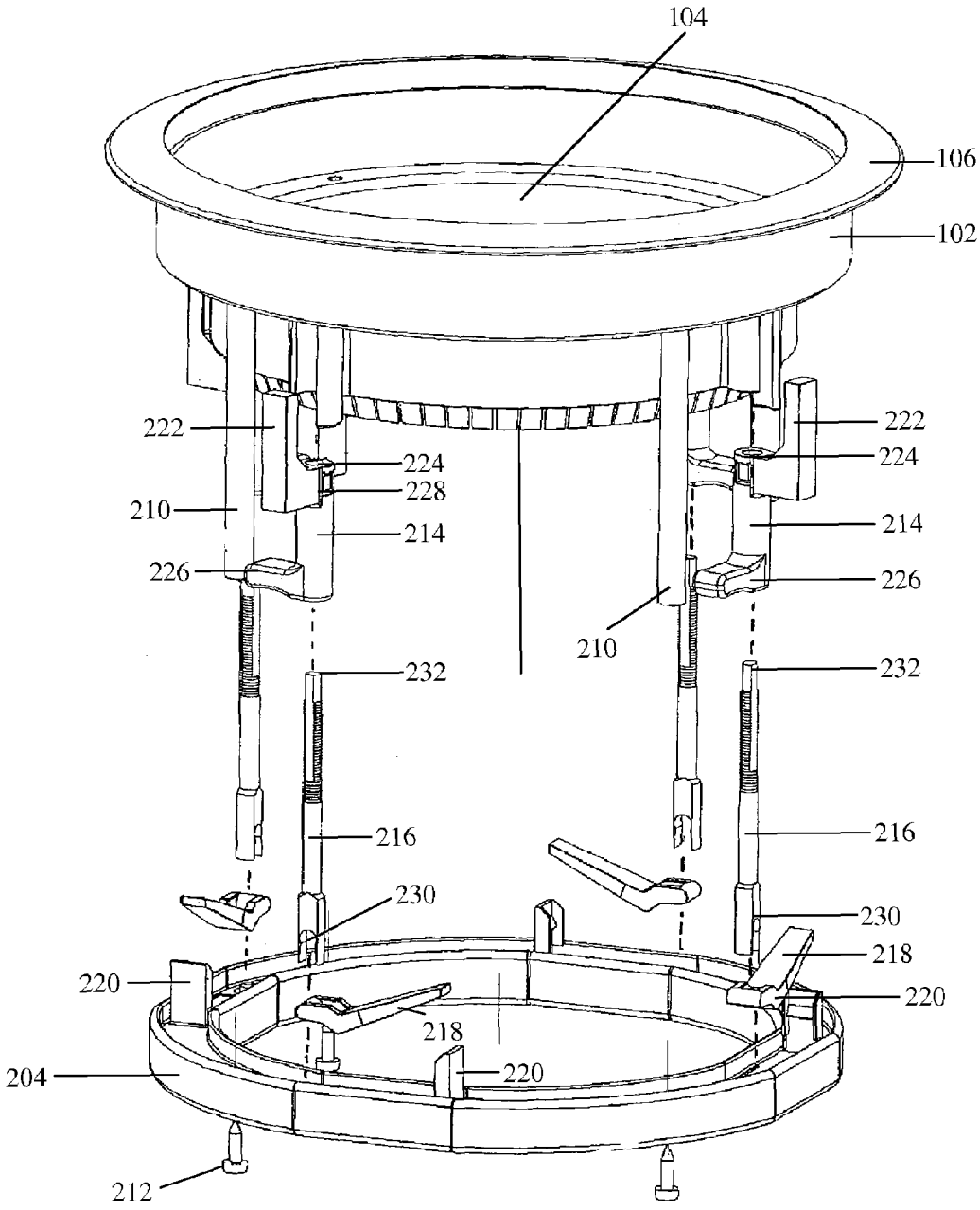
FIG. 2 illustrates one implementation of the mounting frame assembly, including a tool-less fastening system to secure the mounting frame assembly within the ceiling or wall recess.

FIG. 2 illustrates one implementation of the mounting frame assembly 102, including a tool-less fastening system to secure the mounting frame assembly 102 within the ceiling or wall recess. The tool-less fastening system includes a ratcheting retainer or fastener 214, a ratchet post 216, a latch 218, and a latch receiver 220. The ratcheting retainer 214 includes a retaining arm 222, a sleeve 224, and an adjusting arm 226. The sleeve 224 permits the ratchet post 216 to pass through the ratcheting retainer 214. One or more pins or wedges 228 serve to secure a threaded portion of the ratchet post 216 as discussed in more detail below. The latch 218 is movably coupled to a receiving end 230 of the ratchet post 216. When installed, the opposite end of the latch 218 is secured by the latch receiver 220. When the frame assembly 102 is constructed, the ratchet post 216 passes through the sleeve 224 of the ratcheting retainer 214, with a first end 232 of the ratchet post 116 fitting into a cavity in the mounting frame assembly 102 and a second end 230 fitting into a cavity in the retaining frame 204. The retaining frame 204 is coupled to one or more posts 210 to secure the tool-less fastening components 214, 216, 218 between the mounting frame assembly 102 and retaining frame 204.

According to one implementation of the invention, the ratchet post 216 includes an opening 230 into which one end of the latch 218 is inserted. The ratchet post 216 includes a first section of teeth or threads along a first longitudinal portion of the post 216 and a substantially bare or smooth surface along a second longitudinal portion of the post 216. When the mounting frame assembly 102 is assembled, the first end 232 of the ratchet post 216 is inserted into a cavity in the mounting frame assembly 102.

The mounting frame assembly 102 is inserted into the wall or ceiling recess with the ratcheting retainers 214 in a retracted position that permits the unobstructed insertion of the mounting frame assembly 102 into the wall or ceiling recess. Once the mounting frame assembly 102 is inserted in place, the installer can reach through the center opening 104 to rotate the ratcheting fastener 214 and slide it toward the border flange 106. This causes the retaining arm 222 to press against the back surface of the sheetrock or drywall, in the wall or ceiling, and secure the frame assembly 102 in place. That is, the mounting frame assembly 102 is secured by the border flange 106, which presses against a first surface of the sheetrock, and the ratcheting fastener 214, which presses against an opposite second surface of the sheetrock or drywall.

In one implementation of the invention the ratcheting retainer 214 is in a first position so that it does not obstruct the insertion of the mounting frame assembly 102 into the opening in the wall or ceiling. Once inside the recess, an installer may rotate the ratcheting retainer 214, by reaching through the opening 104, rotating the adjusting arm to a second position, and pressing the adjusting arm toward the border flange 106 to secure the ratcheting retainer against the second surface of the sheetrock. In such implementation, the ratchet post and latch 218 are positioned and secured such that the pins or fingers 228 rest along the second longitudinal portion of the post 216, which is substantially smooth and without teeth. When the ratcheting retainer 214 is rotated for securing the mounting frame assembly 102, the pins or fingers 128 engage the teeth along the first longitudinal portion of the post 116.

Figure 3:
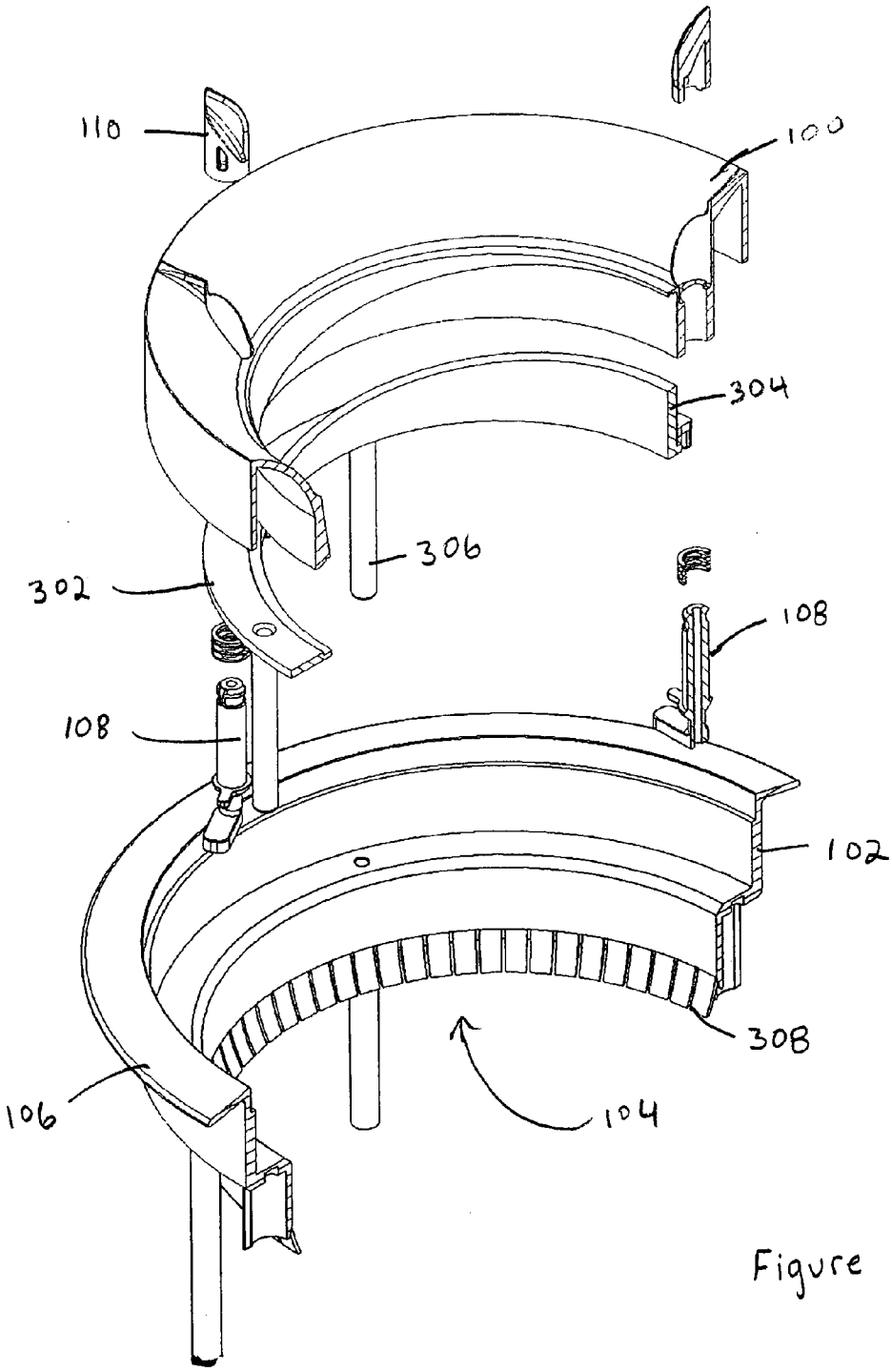
FIG. 3 illustrates a cross-sectional view of the mounting frame assembly and baffle assembly fastening system illustrated in FIG. 1.

FIG. 3 illustrates a cut-out view of the mounting frame assembly 102 and baffle assembly fastening system 100 illustrated in FIG. 1. The baffle assembly 100 is inserted into the mounting frame assembly 102 with a simple, linear motion that does not require any pre-alignment. The baffle 100 includes a retaining ring 302, fastened to the baffle 100, and having a plurality of aligning posts 306 that serve to align the baffle assembly 100 as it is inserted within opening 104 in the mounting frame assembly 102. The mounting frame assembly 102 includes a plurality of spring arms 308 that are bent toward the opening 104. The spring arms 308 may flex outwardly as the aligning posts 306 are inserted. However, those spring arms 308 that are not in contact with the aligning posts 306 remain bent towards the opening 104.

After the baffle 100 has been inserted into the opening 104 beyond a given point, the baffle 100 is retained in place by the engagement of one or more fasteners.

Figure 4:
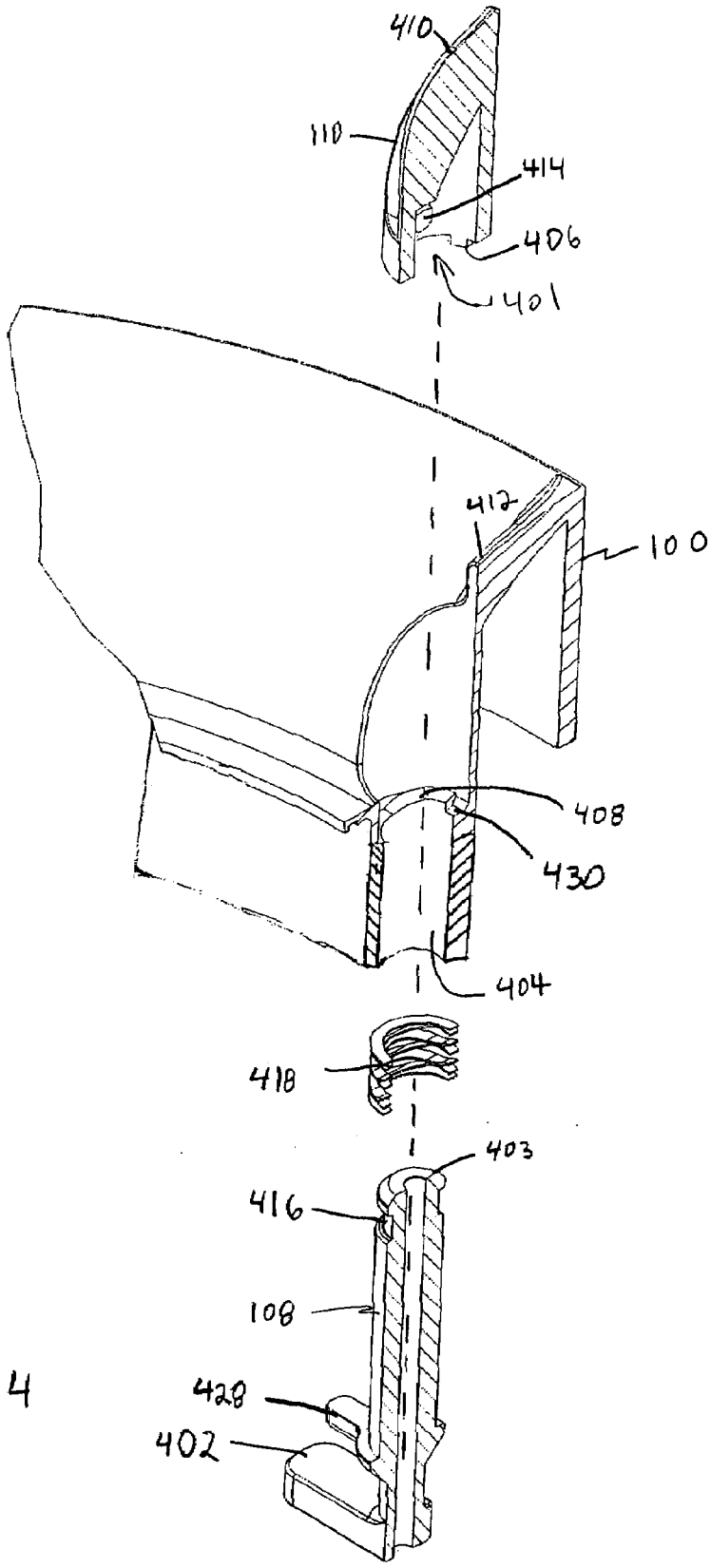
FIG. 4 illustrates a cross-sectional exploded view of a tool-less fastening system that may be employed to secure the baffle 100 to a mounting frame assembly according to one embodiment of the invention

FIG. 4 illustrates a cross-sectional exploded view of a tool-less fastening system that may be employed to secure the baffle 100 to a mounting frame assembly according to one embodiment of the invention. The tool-less fastening system includes a tensioning pin 108 that passes through a tensioning spring 418, then passes through an opening 404 in the baffle 110 and inserts into a cavity 401 in a knob 110.

Figure 5:
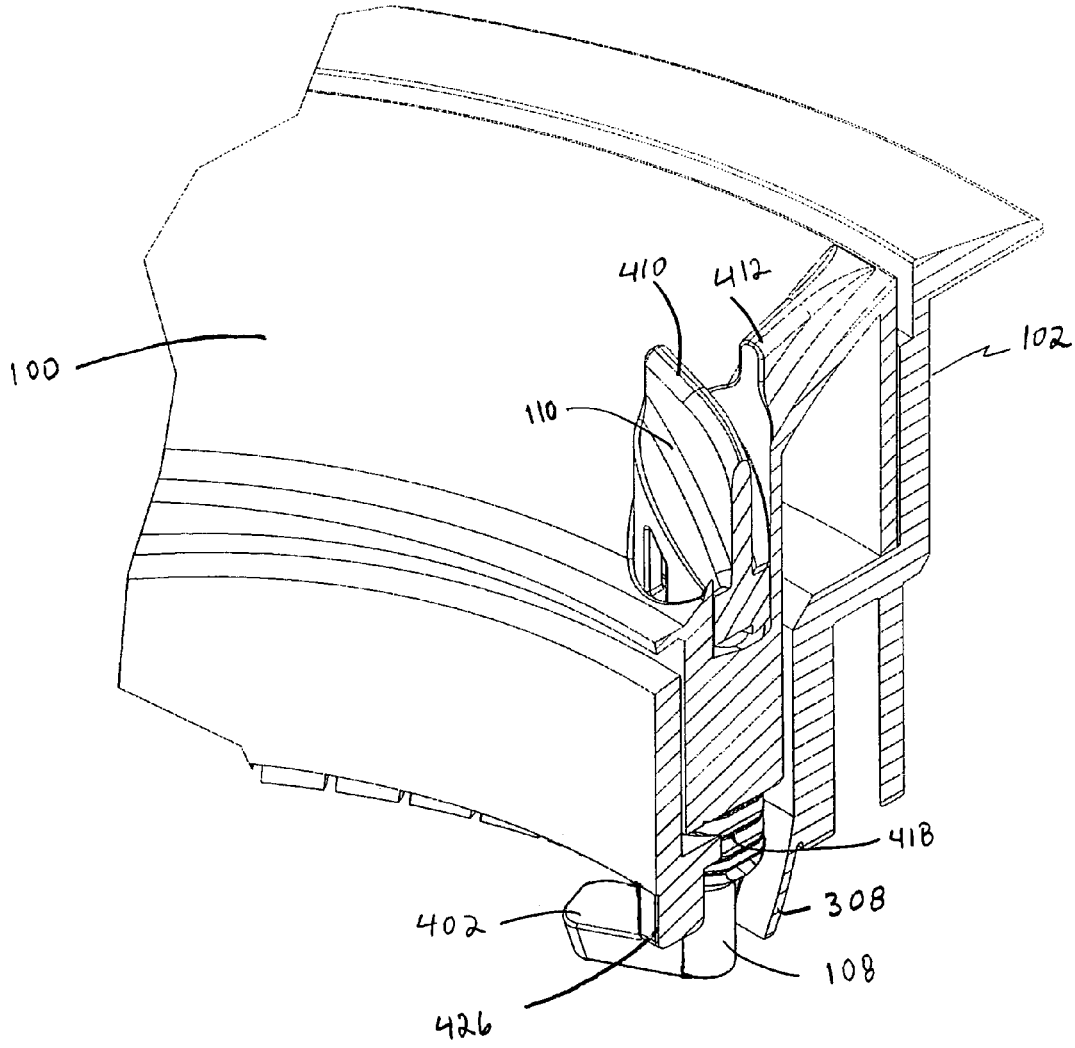
FIGS. 5 and 6 illustrate two positions of the tool-less fastening system that may be employed to secure a baffle to a mounting frame assembly according to one embodiment of the invention.
Figure 6:
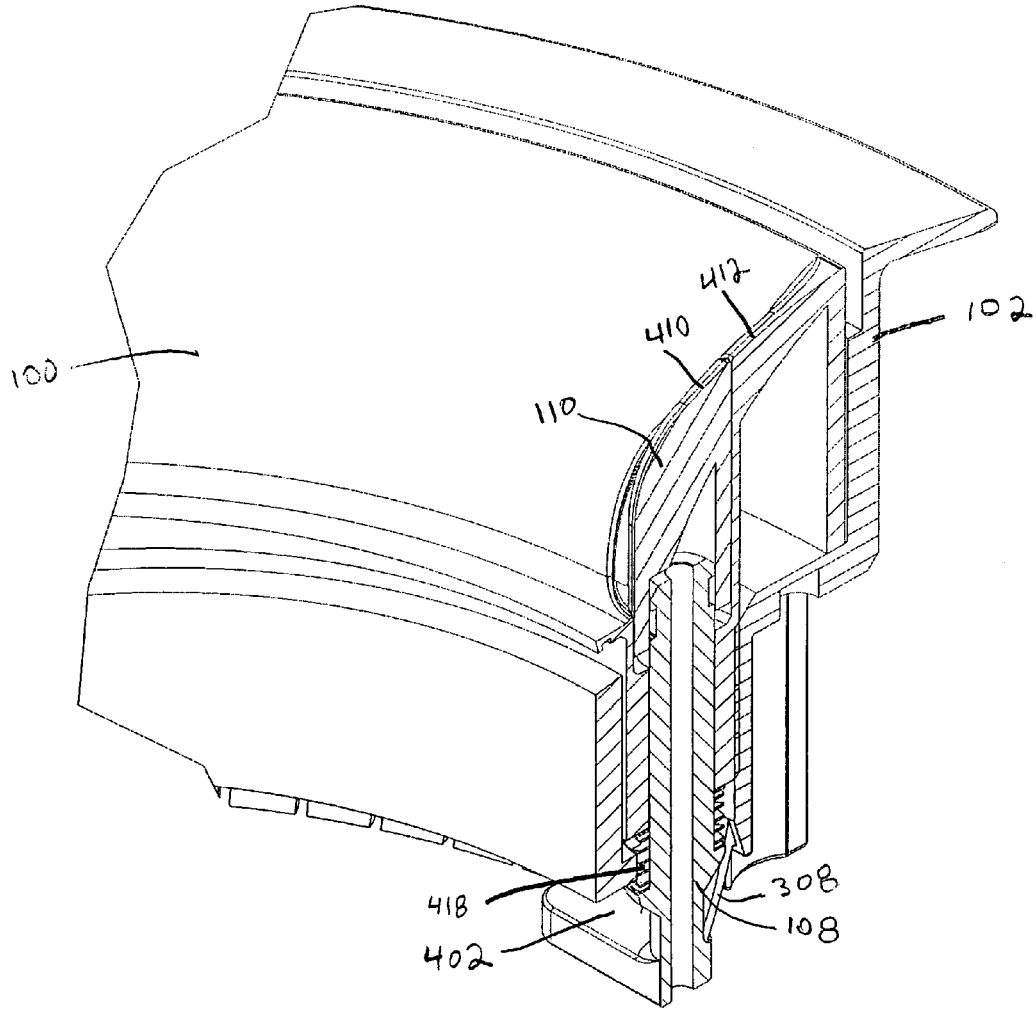

FIGS. 5 and 6 illustrate two positions of the tool-less fastening system that may be employed to secure a baffle 100 to a mounting frame assembly 102 according to one embodiment of the invention. FIG. 5 illustrates a cross-sectional view of a fastener 108 and 110 at a first position when the baffle 100 is disengaged from (not secured to) the mounting frame assembly 102. FIG. 6 illustrates a second position of the fasteners 108 and 110 when the baffle 100 is secured to the mounting frame assembly 102.

Figure 7:
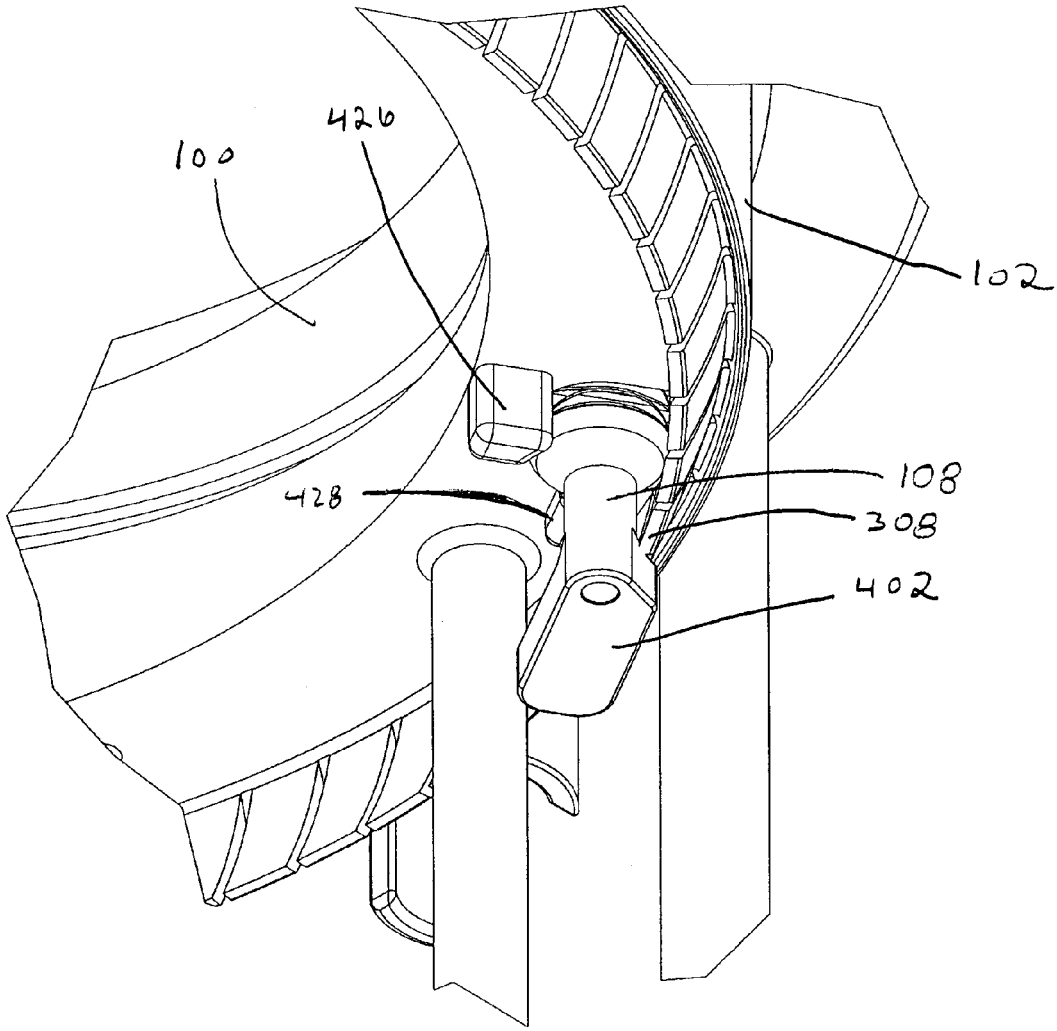
FIG. 7 illustrates an underside view of the tensioning pin in the secured position with the foot over the spring fingers according to one implementation of the invention.

The fastening system includes one or more tensioning pins 108 coupled to knobs 110. As illustrated in FIG. 6, the knob 110 is rotated to cause a foot 402 to rotate and push past the spring fingers 308. Once past the spring fingers 308, as illustrated in FIG. 6, the tensioning pin offset foot 402 is prevented from disengaging from the mounting frame assembly 102 by the position and spring tension of the spring fingers 308. FIG. 7 illustrates an underside view of the tensioning pin 108 in the secured position with the foot 402 over the spring fingers 308 to secure the baffle 100 to the frame assembly 102 according to one implementation of the invention.

Even when the baffle 100 is engaged with the mounting frame assembly 102, as illustrated in FIG. 6, the baffle 100 remains free to rotate inside the mounting frame assembly 102. That is, when in the engaged position, the securing foot 402 may slide along the upper edge of the spring arms 308 as the baffle is rotated.

In one implementation of the invention, the fastening system is assembled as part of the baffle 100. A first end 403 of the tensioning pin 108 passes through a passage 404 in the baffle 100 and is coupled to a receiving cavity 401 in the knob 110.

The fastening system may further include a feature that lifts the tensioning pin 108 in such a way that it locks the rotating baffle 100 to the mounting frame assembly 102. In one implementation of the invention, this is accomplished through the engagement of the knob's ramp pin 406 with the rotating baffle's tension ramp 408 as the knob 110 is rotated clockwise ninety degrees (90°) from its initial preset position (unlocked, FIG. 5) into its full lock position (FIG. 6). In one embodiment of the invention, the full lock position is indicated to an installer when the knob finger actuator 410 is aligned with the rotating baffle's knob alignment rib 412. The unlocked, initial preset position is approximately ninety degrees (90°) counter-clockwise from the knob's 110 full lock position.

The tensioning pin 108 is rotationally secured to the rotating baffle 100 by retaining pins 414 found on the inside of the knob 110. These retaining pins 414 engage the tensioning pin 108 via matching slots 420 on the post end 403 of the tensioning pin 108. After sliding down the engagement slot 420, illustrated in FIG. 8, the knob's retaining pins 414 are free to rotate clockwise past the disassembly stop 422 into the knob retention slot 416 wherein it is free to rotate approximately ninety degrees (90°).

Figure 8:
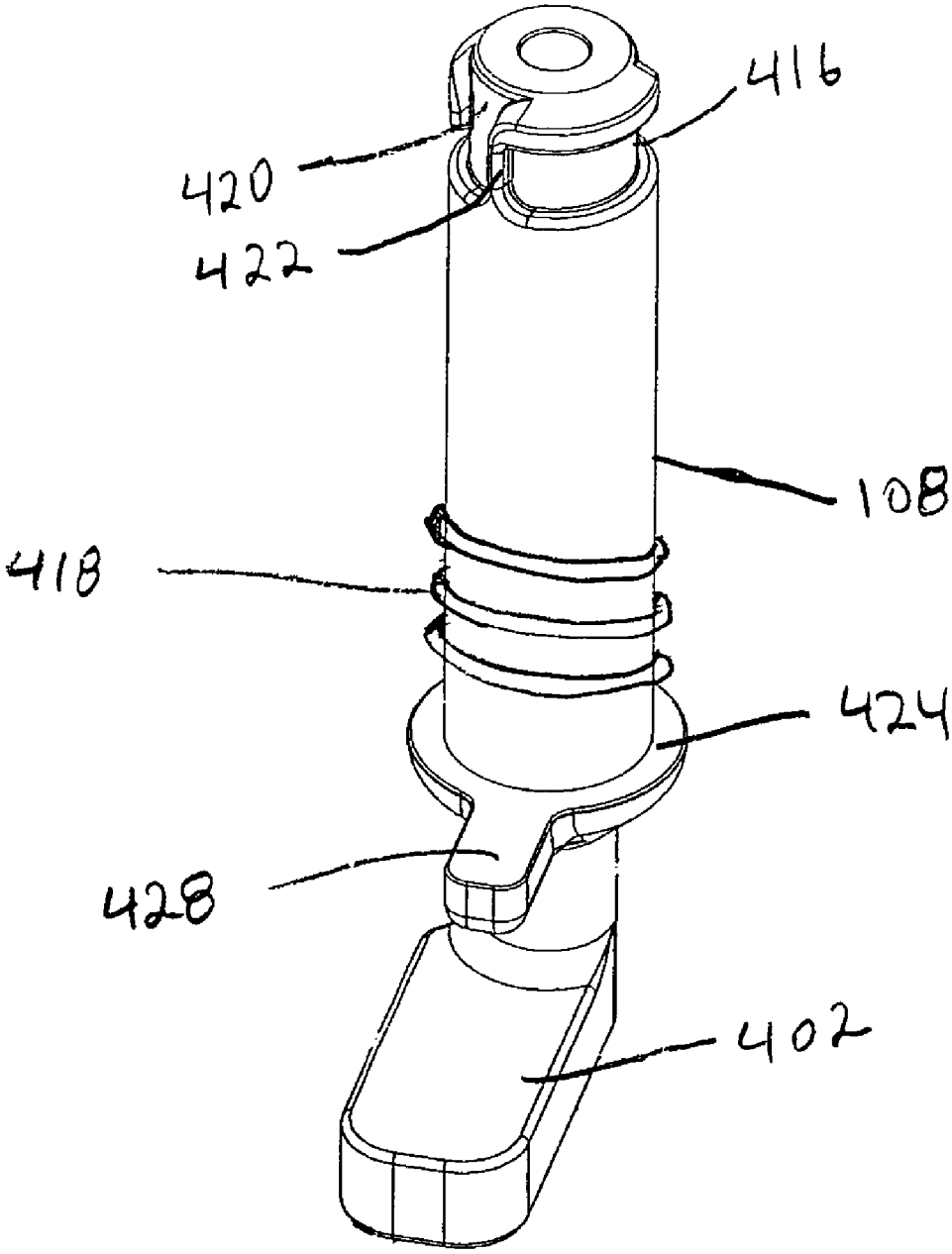
FIG. 8 illustrates a tensioning pin used to secure a baffle to a mounting frame assembly according to one embodiment of the invention.

FIG. 8 illustrates a tensioning pin 108 used to secure a baffle 100 to a mounting frame assembly 102 according to one embodiment of the invention. A tensioning spring 418 is mounted around the tensioning pin collar 424 (FIG. 8) to press against the baffle 100 and prevent the knob's retaining pins 414 from slipping past the engagement slot and disengaging the knob 110 from the tensioning pin 108.

As illustrated in FIGS. 5 and 7, rotation-limiting stops 426 are part of the inner rotating baffle 100 according to one aspect of an embodiment of the invention. The tensioning pin 108 includes a rotation-limiting arm 428 that restrict the pin's rotation when the arm 428 comes into contact with the rotation-limiting stops 426. The tensioning pin's 108 rotation may be limited by stops 426 molded on the retaining ring 302 along the inner perimeter of the baffle 100 and the outer perimeter of the baffle adjacent to the spring fingers 308. These stops 426 may be positioned to allow the tensioning pin 108 to rotate approximately ninety degrees (90°) from the preset/disengaged position to the full lock/engaged position. When the knob 110 is rotated counter-clockwise past the preset/disengaged position, the knob's retaining pins 414 engages the tensioning pin's disassembly stop 422 causing the tensioning pin 108 to rotate and, thereby, disengaging the tensioning pin's foot 402 from the mounting frame's spring fingers 308. Rotating the knob 110 clockwise ninety degrees (90°), from its fully disengaged position to the fully engaged position, causes the tensioning pin 108 to rotate, returning it to the preset position.

The baffle assembly 100 may be inserted into the mounting frame assembly 102 or removed from the mounting frame assembly 102 when the tensioning pins 108 are in the disengaged position (FIG. 5) (i.e., the pin's foot 402 is disengaged from the spring fingers 308). Once the baffle assembly 100 is inserted into the mounting frame assembly 102, the tool-less fastening system may secure the baffle assembly to the mounting frame assembly 102. To engage the pin's foot 402 with the spring fingers 308, the knob's ramp pin 406 travels along the baffle's tensioning ramp 408 as the knob 110 is rotated to the secured position where the pin 406 engages a notch 430. FIGS. 6 and 7 illustrate the knob 110 and tensioning pin 108 in the secured or engaged position. Disengaging the tensioning pin 108 from the spring fingers 308 is accomplished by pulling the knob away from the pin to release the ramp pin 406 from the notch 430 and turning the knob 110 counter-clockwise.

Figure 9:
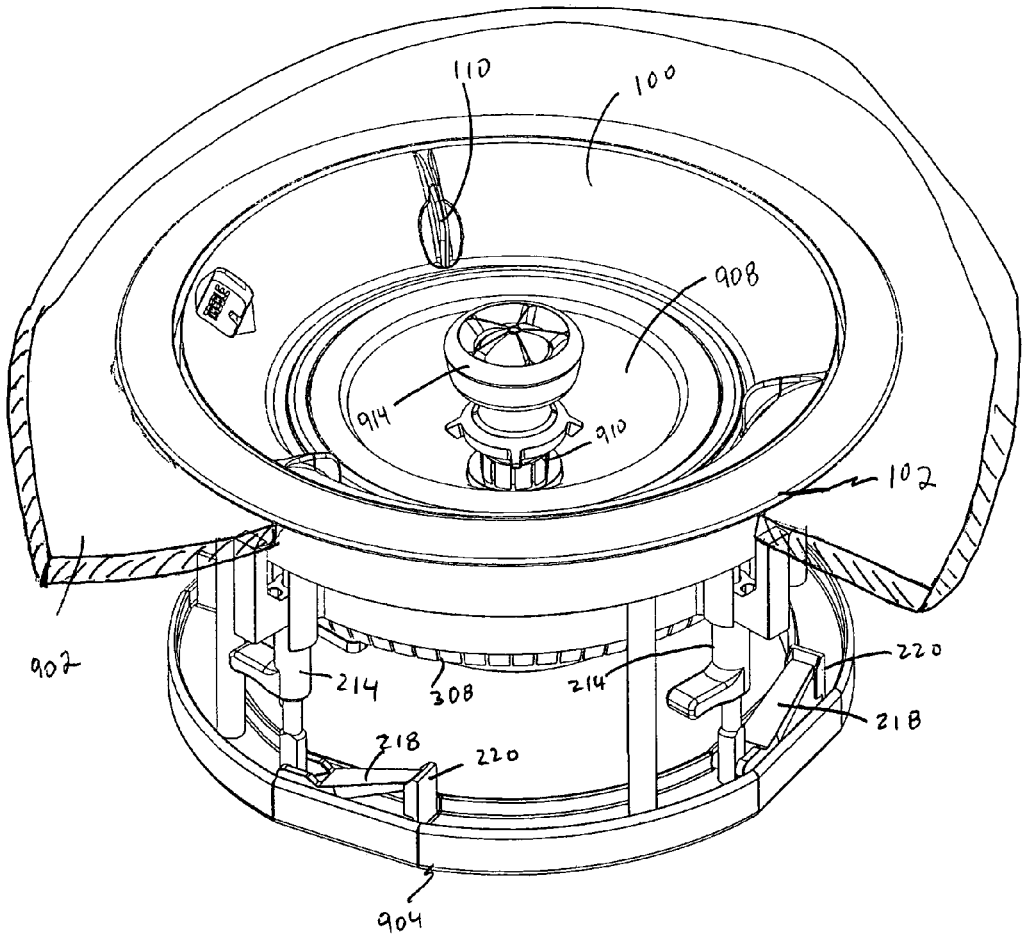
FIG. 9 illustrates a baffle assembly, coupled to a mounting frame assembly and mounted on a surface according to one embodiment of the invention.
Figure 10:
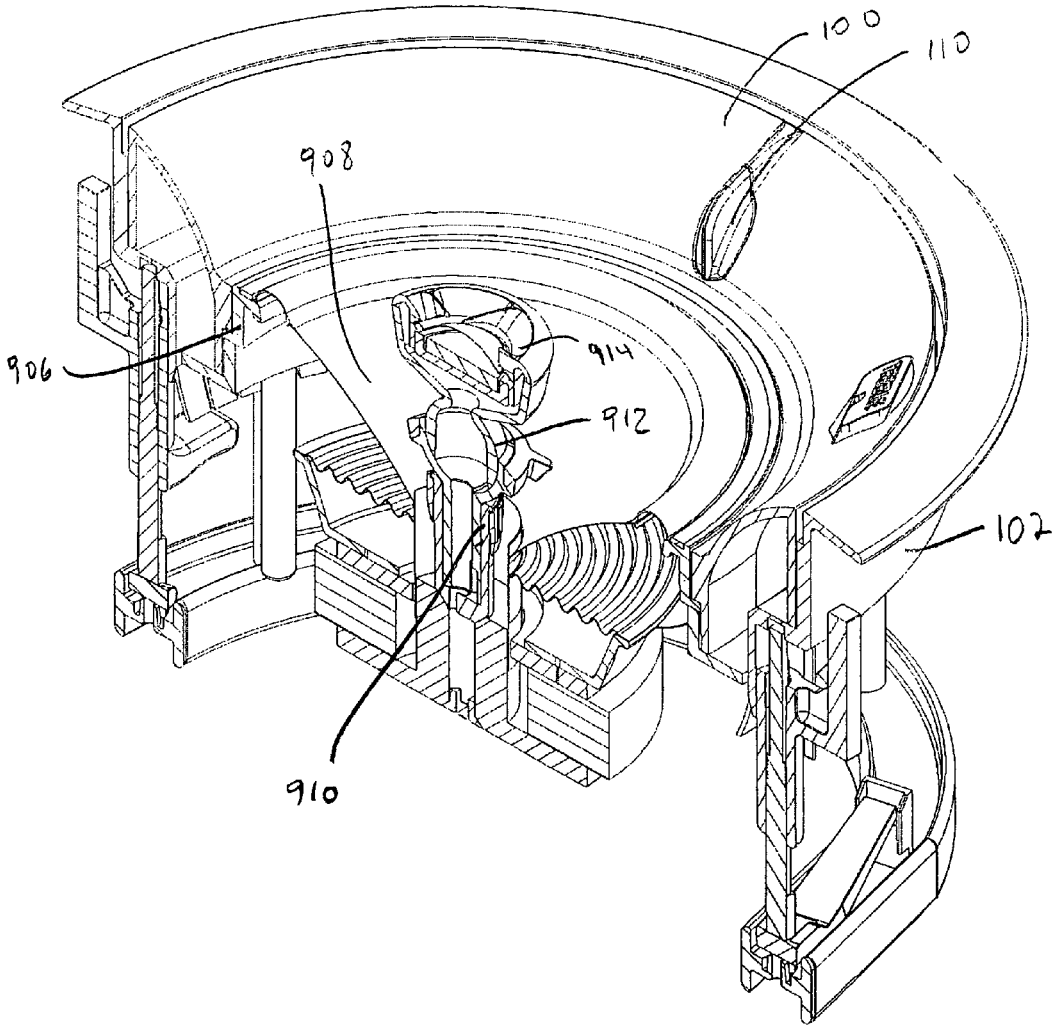
FIG. 10 illustrates a cross sectional view of the baffle assembly and mounting frame assembly illustrated in FIG. 9.

FIG. 9 illustrates a baffle assembly 100, coupled to a mounting frame assembly 102 and mounted on a surface 902 according to one embodiment of the invention. FIG. 10 illustrates a cross sectional view of the baffle assembly 100 and mounting frame assembly 102 illustrated in FIG. 9. An inner fixture mounting assembly 906 serves to support a fixture 908, such as a speaker. The inner fixture mounting assembly 906 may be rotationally mounted within the baffle assembly 100. The inner fixture mounting assembly 906 may be rotated three hundred sixty degrees (360°) and angled to provide a desired position for the fixture 908 mounted therein.

According to one implementation, a retaining ring 302 (FIGS. 1 and 2), which is part of the baffle assembly 100, includes an angled wall 304 along its inner circumference. The inner mounting assembly 906 includes angled rim that slides against the angled wall edge 304 of the baffle assembly 100 to provide the desired angle for the fixture 908, such as a speaker, that may be mounted in the inner mounting assembly. That is, the angled rim turns against a ridge on the angled wall 304. Thus, a desired angle, within a certain range of angles, may be achieved by rotating the inner mounting assembly 906.

The range of fixture angles that can be achieved by this system will depend on the angles provided by the angled rim and angled ridge. Additionally, as previously discussed, the baffle assembly 100 can also be rotated three hundred sixty degrees, consequently turning the fixture 908 attached to the inner mounting assembly 906, to achieve the desired angle and direction.

According to one implementation of the invention, an extendable post assembly 910 may be part of the fixture 908. The extendable post assembly 910 may include a ball and socket support 912 on which a second fixture 914, such as a woofer, may be mounted.

Various embodiments of the invention may be implemented using parts, fasteners, frames, baffles, etc., constructed from one or more materials, or combination of material, including plastic, metal, polymers, and/or any other material.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled, in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A baffle assembly for an audio transducer comprising:

a baffle frame defining an opening to receive a fixture, the baffle frame having an exposed first surface;

a rotatable circular retaining ring coupled to the baffle frame, the retaining ring having at least one rotation-limiting stop; and a fastener rotationally coupled to the baffle frame, the fastener having a rotation-limiting arm to engage with the at least one rotation-limiting stop of the retaining ring, the fastener extending from the exposed first surface to secure the baffle assembly to a recessed mounting frame, wherein the fastener can be manually rotated from a disengaged position to an engaged position in less than one full turn, wherein the retaining ring remains rotatable even after the fastener is in the engaged position.

2. The baffle assembly of claim 1 wherein the retaining ring has a plurality of aligning posts that serve to align the baffle assembly as it is inserted into a recessed mounting frame.

3. The baffle assembly of claim 2 wherein the retaining ring includes an angled sidewall along the circumference of the opening defined by the baffle frame.

4. The baffle assembly of claim 3 further comprising: an inner mounting assembly to couple to a fixture, the inner mounting assembly having an angled sidewall to slide against the angled sidewall of the retaining ring and provide a desired angle for the fixture.

5. The baffle assembly of claim 1 wherein the fastener includes a tensioning pin, a knob coupled to a first end of the tensioning pin on the exposed first surface, a retaining spring along the tensioning pin and adapted keep the knob coupled to the tensioning pin, and a securing foot coupled to a second end of the tensioning pin wherein the securing foot is adapted to rotate.

6. The baffle assembly of claim 5 wherein rotating the knob causes the tensioning pin and securing foot to rotate and engage one or more spring fingers in the recessed mounting frame to secure the baffle assembly to the recessed mounting frame.

7. The baffle assembly of claim 1 wherein the baffle frame includes at least one passage though which a fastener extends from the exposed first surface to an opposite end, the passage including a tensioning ramp edge along the circumference of the passage, a knob on the fastener rotates on the tensioning ramp edge to secure the baffle assembly.

8. The baffle assembly of claim 1 wherein the fastener can be manually rotated from a disengaged position to an engaged position in approximately one half turn.

9. The baffle assembly of claim 1 wherein the fastener includes a visible finger actuator, the finger actuator to align with a rib on the exposed first surface when the fastener is in the engaged position.

10. The baffle assembly of claim 1 wherein the baffle assembly remains free to rotate three hundred and sixty degrees even when the fastener secures the baffle assembly to the recessed mounting frame.

11. A frame assembly for an audio transducer comprising:

a framing means defining an opening to receive a recessed fixture, the framing means having an exposed first surface and a passage extending from the exposed first surface to an opposite end;

a rotatable circular retaining means coupled to the framing means, the retaining means having at least one rotation-limiting stop; and a fastening means extending though the passage and rotationally coupled to the framing means, the fastening means having a rotation-limiting arm to engage with the at least one rotation-limiting stop of the retaining means, the fastening means extending from the exposed first surface for securing the framing means to a recessed mounting means, wherein the fastening means can be manually rotated from a disengaged position to an engaged position in less than one full turn, wherein the retaining means remains rotatable even after the fastening means is in the engaged position.

12. The frame assembly of claim 11 wherein the fastening means can be manually rotated from a disengaged position to an engaged position in approximately one half turn.

13. The frame assembly of claim 11 wherein the passage includes a tensioning ramp edge along the circumference of the passage, the fastening means rotates on the tensioning ramp edge to secure the frame assembly to the recessed mounting means.

14. The frame assembly of claim 11 wherein the fastening means includes a visible aligning means, the visible aligning means for aligning with a marker on the exposed first surface of a baffle frame when the fastening means is in the engaged position.

15. The frame assembly of claim 11 wherein the framing means remains free to rotate three hundred and sixty degrees even when the fastening means secures the framing means to the recessed mounting means.

16. A fastener for an audio transducer comprising:

a shaft;

a knob coupled to a first end of the shaft, the knob having a visible finger actuator, the finger actuator to align with an aligning marker to indicate an engaged position;

a retaining spring along the shaft and adapted to keep the knob coupled to the shaft;

a securing foot coupled to a second end of the shaft, wherein manually rotating the knob from a disengaged position to an engaged position also rotates the securing foot and the fastener can be manually rotated from a disengaged position to an engaged position in less than one full turn and wherein the securing foot is adapted to rotate, the retaining spring located between the knob and the securing foot; and a rotation limiting arm coupled to the shaft and independent of the securing foot, the rotation limiting arm located between the knob and the securing foot.

17. The fastener of claim 16 wherein the fastener can be manually rotated from a disengaged position to an engaged position in approximately one half turn.

18. An audio transducer mounting device comprising:

a baffle frame defining an opening to receive an audio transducer, the baffle frame having an exposed first surface, the baffle frame including at least one passage from the exposed first surface to an opposite end, the passage including a tensioning ramp edge along the circumference of the passage;

a rotatable circular retaining ring coupled to the baffle frame, the retaining ring having a plurality of aligning posts that serve to align the baffle assembly as it is inserted into a recessed mounting frame, the retaining ring including an angled sidewall along the circumference of the opening defined by the baffle frame;

an inner mounting assembly to mount the audio transducer, the inner mounting assembly having an angled sidewall to slide against the angled sidewall of the retaining ring and provide a desired angle for the audio transducer; and a fastener including a tensioning pin, a knob coupled to a first end of the tensioning pin on the exposed first surface, a retaining spring along the tensioning pin and adapted keep the knob coupled to the tensioning pin, and a securing foot coupled to a second end of the tensioning pin, the fastener rotationally coupled to the baffle frame and extending from the exposed first surface to secure the baffle assembly to a recessed mounting frame, wherein manually rotating the fastener knob causes the securing foot to rotate and engage one or more spring fingers in the recessed mounting frame to secure the baffle assembly to the recessed mounting frame, wherein the retaining ring remains rotatable even after the fastener is in the engaged position.

* * * * *